US006513912B2

(12) United States Patent
Miyamoto et al.

(10) Patent No.: US 6,513,912 B2
(45) Date of Patent: Feb. 4, 2003

(54) HEAT GENERATING ELEMENT FOR PRINTER HEAD AND MANUFACTURING METHOD THEREFOR

(75) Inventors: Takaaki Miyamoto, Kanagawa (JP); Toru Tanikawa, Kanagawa (JP); Minoru Kohno, Tokyo (JP); Hideki Mori, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/918,836

(22) Filed: Jul. 31, 2001

(65) Prior Publication Data

US 2002/0057314 A1 May 16, 2002

(30) Foreign Application Priority Data

Aug. 7, 2000 (JP) ..... 2000-243996

(51) Int. Cl.[7] ..... B41J 2/05
(52) U.S. Cl. ..... 347/62
(58) Field of Search ..... 347/56, 61, 65, 347/62, 63, 67

(56) References Cited

U.S. PATENT DOCUMENTS

| | | | | |
|---|---|---|---|---|
| 5,008,689 A | | 4/1991 | Pan et al. | 347/63 |
| 5,710,070 A | * | 1/1998 | Chan | 347/62 DR |
| 5,870,121 A | | 2/1999 | Chan | 347/59 |

FOREIGN PATENT DOCUMENTS

| | | | |
|---|---|---|---|
| JP | 8267761 | 10/1996 | B41J/2/16 |
| JP | 10119284 | 5/1998 | B41J/2/05 |

* cited by examiner

*Primary Examiner*—John Barlow
*Assistant Examiner*—Juanita Stephens
(74) *Attorney, Agent, or Firm*—Sonnenschein, Nath & Rosenthal

(57) ABSTRACT

Heat-generating elements are formed by depositing at least a IV A metal layer or a V A metal layer, followed by depositing a resistor material thereupon. Thus, the reliability of heat-generating elements applied to thermal type ink-jet printers, for example, is improved as compared to conventional arrangements.

7 Claims, 8 Drawing Sheets

FIG. 8

| MATERIAL | LINEAR EXPANSION COEFFICIENT [1/K] |
|---|---|
| Si | 2.44E-6 |
| SiN | 0.80E-6 |
| Ta | 7.0E-6 |
| TaN | 3.6E-6 |
| TiN | 1.22E-6 |

HEAT GENERATING ELEMENT FOR PRINTER HEAD AND MANUFACTURING METHOD THEREFOR

RELATED APPLICATION DATA

The present application claims priority to Japanese Application No. P2000-243996 filed Aug. 7, 2000, which application is incorporated herein by reference to the extent permitted by law.

BACKGROUND OF THE INVENTION

1. Field of the Invention

The present invention relates to a printer, a printer head, and a manufacturing method for the printer head, and can be applied in, for example, thermal type ink-jet printers.

2. Description of the Related Art

In recent years, in the field of image processing and the like, there has been increased needs for color hard copies. Conventionally, the sublimation thermal transfer method, the fusing thermal transfer method, the ink-jet method, the electro-photography method, the heat-developing silver-salt method, and other like color hard copying methods have been proposed to deal with such needs.

Of these methods, the ink-jet method can output high-quality images with a simple configuration. The reason is that this method causes droplets of a recording fluid (ink) to fly from nozzles provided on a recording head, which adhere to the object of recording and form dots. The ink-jet method is classified into the electrostatic gravitation method, the continuous vibration generating method (piezo method), the thermal method, etc., according to differences in the method of causing the ink to fly.

Of these methods, the thermal method is a method wherein bubbles are generated by local heating of ink, and ink is pressed out from nozzles which are discharging orifices, by these bubbles, thereby causing the ink to fly to the printing medium. Accordingly, color images can be printed with a simple configuration.

A thermal printer is configured using a so-called printer-head. The printer head is arranged such that heat-generating elements for heating ink, transistors for driving the heat-generating elements, and so forth, are mounted on the printer head.

Now, the heat-generating elements are formed by depositing a resistor material such as tantalum, tantalum aluminum, titanium nitride, etc., on a predetermined substrate by sputtering, which is widely used in semiconductor forming processes, forming aluminum electrodes thereupon, following which a protective layer of a silicon nitride film or the like is formed. The printer head has a cavitation-resistant layer, ink liquid chambers, and nozzles formed of a tantalum film on the upper layer of this protective layer, thereby enabling ink in the ink liquid chambers to be heated by the heating of the heat-generating elements. Further, the printer head is arranged such that electric power can be supplied to the heat-generating elements from MOS (Metal Oxide Semiconductor) or bipolar transistors, and further configured so as to control the operation of the transistors by predetermined driving circuits, thereby driving with driving circuits to adhere ink liquid drops on paper.

Now, with the heat-generating elements at the time of printing, electricity is repeatedly applied by pulse voltage being repeatedly applied. With conventional printer heads, the repeated application of electricity may change the resistance value and eventually lead to line breakage of resistor elements, and accordingly reliability has been insufficient.

SUMMARY OF THE INVENTION

The present invention has been made in light of the above, and accordingly it is an object thereof to provide a printer, a printer head, and a manufacturing method for the printer head, for improving the reliability of heat-generating elements over that of conventional arrangements.

In order to solve the problems, with the present invention, application is made to a printer, printer head, and a manufacturing method for the printer head, and the heat-generating element is formed by depositing at least a IV A metal layer or a V A metal layer, followed by depositing a resistor material upon this metal layer.

According to the present invention, a IV A metal layer or V A metal layer is introduced between these, and the IV A metal layer or V A metal layer closely adheres with sufficient strength to the lower layer which is silicon nitride film, silicon oxide film, etc., due to forming compounds therewith and the interface, and also closely adheres with sufficient strength to the upper layer of TiN or the like making of the heat-generating elements, due to being metal material of the same type. Thus, even in the event that thermal stress is repeated, peeling off of the heat-generating elements can be prevented, and the reliability of the heat-generating element can be improved over conventional arrangements.

BRIEF DESCRIPTION OF THE DRAWINGS

FIG. 8 is a table illustrating the linear expansion percentage of various materials.

DESCRIPTION OF THE PREFERRED EMBODIMENTS

Embodiments of the present invention will now be described with reference to the drawings as appropriate.

Figure 1:
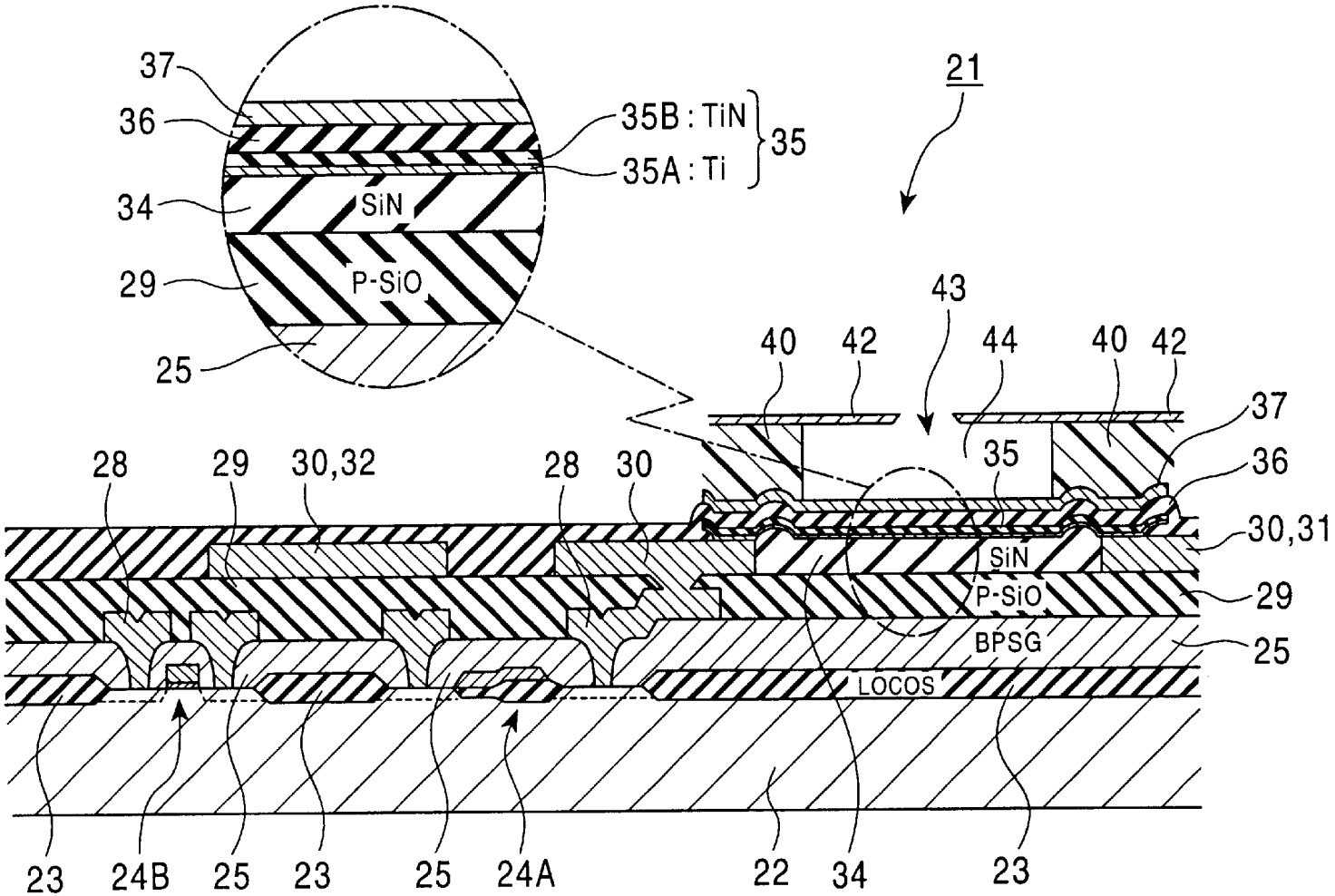
FIG. 1 is a cross-sectional diagram illustrating a printer head applied to the printer according to the first embodiment of the present invention.

First Embodiment 1-1 Configuration of the First Embodiment layer, ink liquid chambers, and nozzles formed of a tantalum film on the upper layer of this protective layer, thereby enabling ink in the ink liquid chambers to be heated by the heating of the heat-generating elements. Further, the printer head is arranged such that electric power can be supplied to the heat-generating elements from MOS (Metal Oxide Semiconductor) or bipolar transistors, and further configured so as to control the operation of the transistors by predetermined driving circuits, thereby driving with driving circuits to adhere ink liquid drops on paper. FIG. 1 is a cross-sectional diagram illustrating a printer head. The printer according to this first embodiment is configured using this printer head 21.

The printer head 21 comprises, on a cleansed p-type silicon substrate 22, device separating areas (LOCOS: Local oxidation of silicon) 23 for separating transistors. The device separating areas 23 are formed by depositing a silicon nitride film on the p-type silicon substrate 22, partially removing and patterning the silicon nitride film by a lithography process and reactive ion etching processes, and subjecting the patterned pattern to thermal oxidation processing.

Next, following a cleansing process, gates of a tungsten silicide/poly-silicon/thermally oxidized film structure are formed on the transistor forming areas left between the device separating areas 23 on the printer head 21, and further subjected to an ion injection process for forming source and drain areas, and a heat treatment process, thereby forming MOS transistors.

Formed on the printer head 21 are switching transistors 24A for driving the heat-generating elements, which are connected to the electric power source of 30 V by the MOS transistors via the heat-generating elements, and transistors 24B of a logic integrated circuit for driving the switching transistors 24A, operating off of electric power source voltage 5 V.

Next, on the printer head 21 is deposited a BPSG (BoroPhosepho Silicate Glass) film 25 by CVD (Chemical Vapor Deposition), and contact holes are formed on the silicon semiconductor dispersion layer (sources and drains) by a photolithography process and reactive ion etching using a CFx gas.

Next, the printer head 21 is cleansed with dilute hydrofluoric acid, following which a titanium film of 20 nm in thickness and a titanium nitride barrier metal of 60 nm in thickness sequentially deposited by sputtering, and aluminum with 0.6 at % copper added is deposited to a thickness of 600 nm. Further, a first layer of wiring pattern 28 is formed by a photolithography process and dry etching process. With the printer head 21, the MOS transistor making up the driving circuit are mutually connected by the first layer of wiring pattern 28, a driving circuit is formed by the logic integrated circuit, and the heat-generating elements are driven by driving of the switching transistors 24A by the driving circuit.

Next, with the printer head 21, an oxidized silicon film (so-called TEOS) 29 is deposited by CVD on the first layer of aluminum wiring pattern 28, and the oxidized silicon film 29 is smoothed by a CMP (Chemical Mechanical Polishing) process or resist etch-back.

Next, contact holes (veer holes) connecting to the first layer of aluminum wiring are formed by a photolithography process and a dry etching process. Next, an aluminum wiring pattern is formed in the same manner as with the first layer by sputtering, and a second layer of aluminum wiring pattern 30 is formed by a photolithography process and a dry etching process. With the printer head 21, an electric power line pattern 31 and ground line wiring pattern 32 are formed by the second layer of wiring pattern 30. With the printer head 21, an insulating layer 34 is then formed by depositing a silicon nitride film by CVD, which is smoothed by a resist etch-back process or the like.

Next, with the printer head 21, contact holes (veer holes) connecting to the second layer of aluminum wiring are formed by a photolithography process and a dry etching process.

Further, titanium, which is a IV A metal, is disposed from the lower layer side by sputtering to a thickness of 10 nm to form a buffer layer 35A, following which a titanium nitride layer 35B is deposited to a thickness of 100 nm, and heat-generating elements 35 are created by a photolithography process and a dry etching process. Thus, titanium nitride is applied to the printer head 21 as resistor material for the heat-generating elements 35, thereby forming the heat-generating elements 35 by depositing this resistor material on the silicon nitride film 34 across a titanium film 35A which is a metal of the same type as this titanium nitride and also is a IV A metal.

Next, a silicon nitride film 36 functioning as an ink protecting layer is formed to a thickness of approximately 300 nm, and a tantalum film 37 serving as a cavitation resistance layer is formed to a film thickness of 200 to 300 nm by sputtering. The printer head 21 has ink liquid chambers 44, channels, etc., formed in the next process, and thus is completed (FIG. 1).

Next, sequentially layered on the printer head 21 are a dry film 40 of, for example, a carbon resin, and an orifice plate 42. With the printer head 21, the ink liquid chambers 44 are formed on the heat-generating elements 35 by the dry film 40 and the orifice plate 42, and further, orifices 43 which are minute ink discharging orifices connecting from the ink liquid chambers 44 are formed, and moreover channels and the like for guiding the ink to the ink liquid chambers 44 are formed.

1-2 Operation of the First Embodiment

In the above configuration, with the printer head 21, switching transistors 24A and the like are formed on the p-type silicon substrate 22 and connected by the wiring pattern 28 and the like, following which an insulating layer is formed of a silicon nitride film 34. A buffer layer 35A of titanium which is a IV A metal, and a resistor film 35B of titanium nitride are deposited to form heat-generating elements 35, following which the insulating layer 36, cavitation resistant layer 37, ink liquid chambers 44, channels, and the like are formed.

Ink is guided to the ink liquid chambers 44, the heat-generating elements 35 generate heat by the switching operation of the switching transistors 24A under the control of the driving circuit, thereby locally heating the ink in the ink liquid chambers 44. With the printer head 21, air bubbles are generated due to this heating at the side face of the heating elements 35 in the ink liquid chambers 44, and the bubbles join to form a film bubble which grows. The increased pressure of the bubble presses ink out from the orifices 43 and causes the ink to fly to the object of printing. Thus, with a printer according to the printer head 21, intermittent heating of the heat-generating elements 35 causes ink to sequentially adhere to the object of printing, thereby enabling formation of a desired image.

Now, with the heat-generating elements at the time of printing, electricity is repeatedly applied by pulse voltage being repeatedly applied, and the heat-generating elements are repeatedly heated. With conventional printer heads, as described above, the repeated application of electricity may change the resistance value and eventually lead to line breakage of resistor elements, and accordingly reliability has been insufficient.

Figure 6:
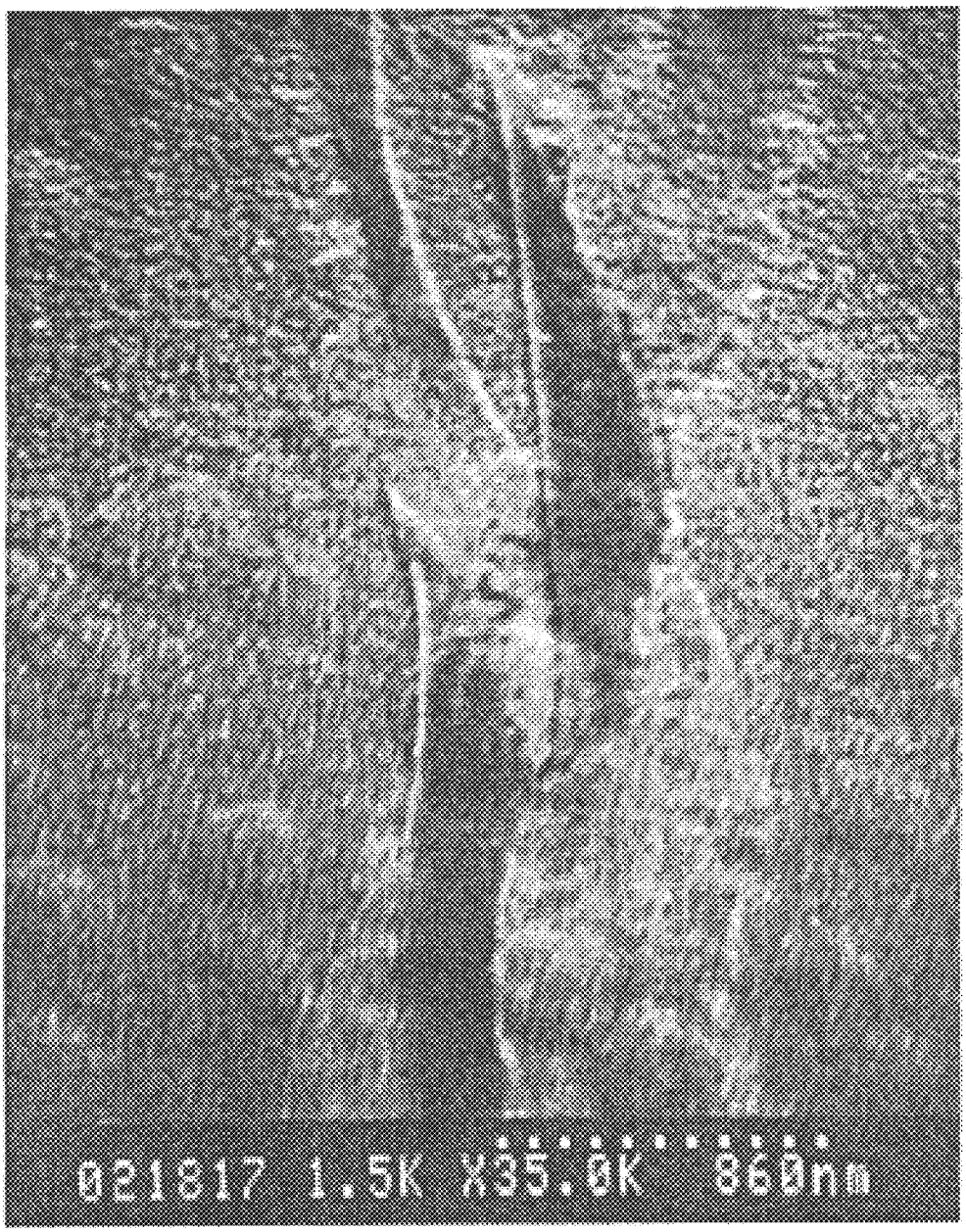
FIG. 6 is a photograph illustrating the heat-generating elements of a conventional printer head.
Figure 7:
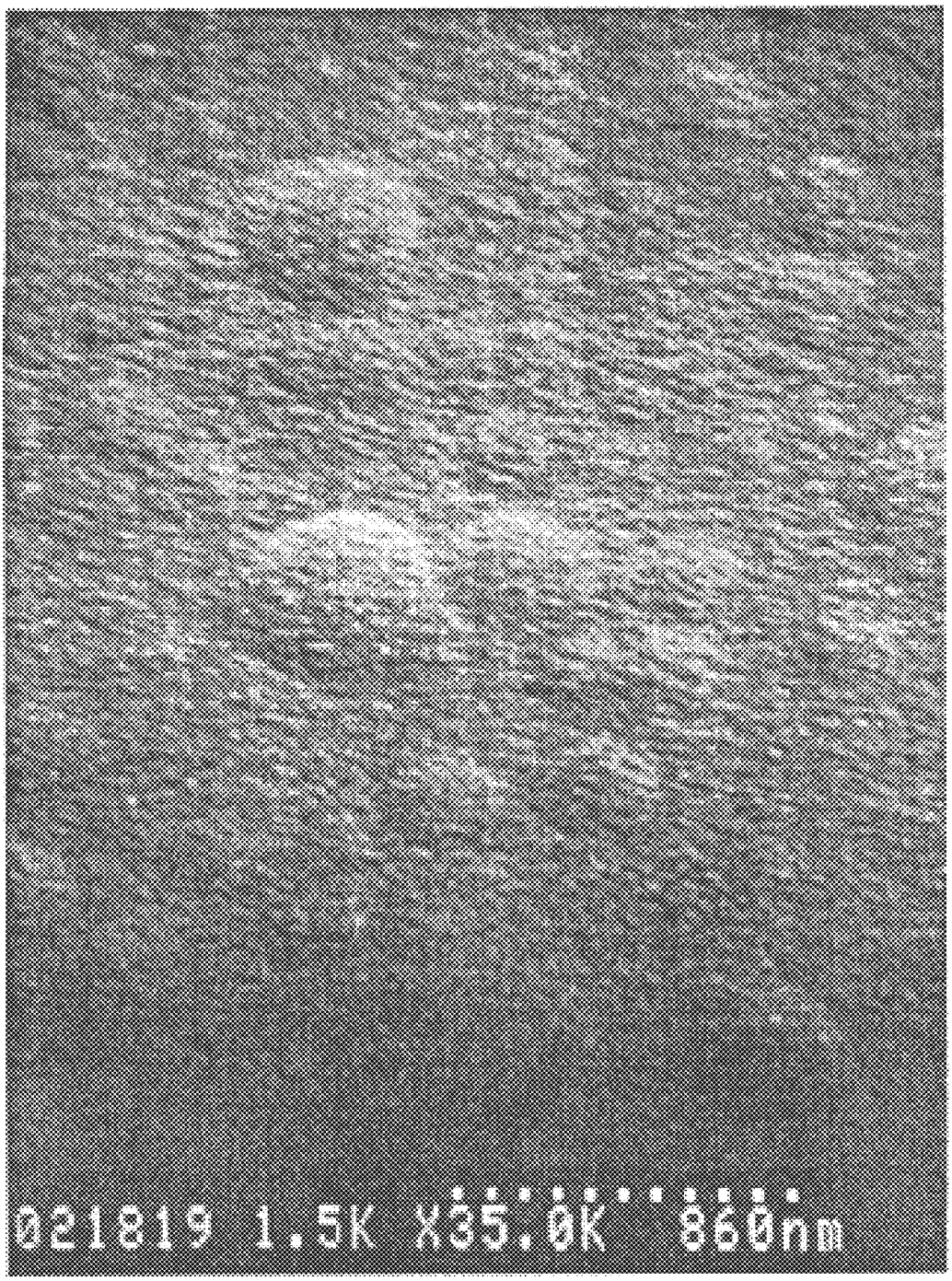
FIG. 7 is another photograph illustrating the heat-generating elements of a conventional printer head.

Now, SEM (Scanning Electron Microscope) observation photographs of a heat-generating element immediately following manufacturing and a heat-generating element regarding which the resistance value has changed due to application of electricity are illustrated in FIGS. 6 and 7. As shown in FIGS. 6 and 7, with elements immediately following manufacturing, a great many dome-shaped minute protrusions, thought to be formed by the titanium nitride film lifting off of the lower layer, are observed. Local cracks were observed in the titanium nitride film with that in which the resistance value had changed. This heat-generating element was formed by depositing titanium nitride on a silicon nitride film to a thickness of 100 nm.

From FIGS. 6 and 7, it is thought that with conventional printer heads, cracks occur in the silicon nitride film due to repeatedly applying thermal stress due to the heat generated by the heat-generating element itself in the state that such dome-shaped portions lifted off have occurred, and it is thought that the resistance value changed due to the cracks. Also, it is thought that such crack spread to eventually lead to line breakage of the heat-generating elements. Also, such portions that have lifted off have poor heat emission as compared to other portions, and it is thought that such local temperature rising accelerates the occurring of cracking. Incidentally, as shown in FIG. 8, the linear expansion coefficient of titanium nitride is greatly different from that of the silicone nitride which is the lower layer of the heat-generating element, and it is thought that great thermal stress is repeated by repeated generating of heat.

Further, this sort of heat-generating element is formed on a silicon nitride film, silicon oxide film, etc., and it was found that in-the event that the heat-generating element is formed directly upon these films, the heat-generating element does not closely adhere with sufficient strength. Accordingly, with conventional configurations, the thermal expansion coefficient of the two differ greatly, so it is thought that cracks occur in the film structure making up the heat-generating element due to the repetitive thermal cycle from repeatedly applying electricity, and eventually the heat-generating element experiences line breakage.

With conventional printer heads, the heat-generating elements 35 which repeat heat generating under driving of such switching transistors 24A are directly formed on a silicon nitride film 34 with which the linear expansion coefficients greatly differ, but with the printer head 21 according to the present embodiment, this is positioned with a buffer layer 35A of titanium which is a IV A metal introduced therebetween.

Figure 2:
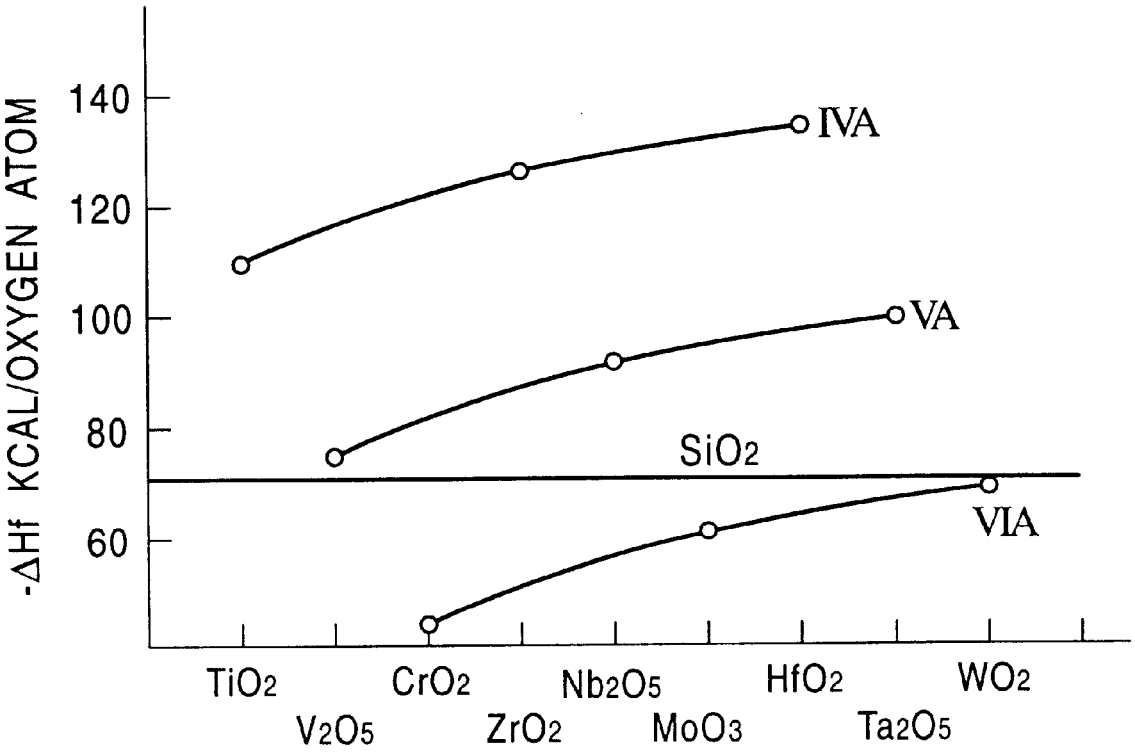
FIG. 2 is a properties curve for describing the operation of the printer head shown in FIG. 1.

FIG. 2 shows a comparison of generated heat of IV A metals (Ti, Zr, Hf) and V A metals (V, Nb, Ta) with that of silicon oxides. These metals are characterized in that the amount of heat generated by oxides is smaller than that of silicon. Accordingly, in the event that these are deposited on a silicon oxide, oxides are generated at the interface, and these metal materials strongly bind to the silicon oxide. With the printer head 21, the lower layer of the heat-generating elements 35 is a silicon nitride, but these metals hold the same relation with silicon nitrides, as well.

Thus, the buffer layer 35A strongly binds with the silicone nitride which is the underlayer. Conversely, these metal materials and the tantalum nitride or the like making up the heat-generating elements 30 are metal materials of the same type, so the buffer layer 35A and the resistor layer 35B can also be made to strongly bind.

Accordingly, with the printer head 21, even in the event that thermal stress is repeatedly applied by heating the ink under conditions wherein the linear expansion coefficients of the silicone nitride which is the lower layer and that of the tantalum nitride which is the resistor material greatly differ, the resistor material can be prevented from peeling off of the lower layer, and consequently change in resistance values, and destruction and the like, of the heat-generating elements 35 can be prevented, thereby markedly improving the reliability of the heat-generating elements 35 as compared to the conventional.

Figure 3:
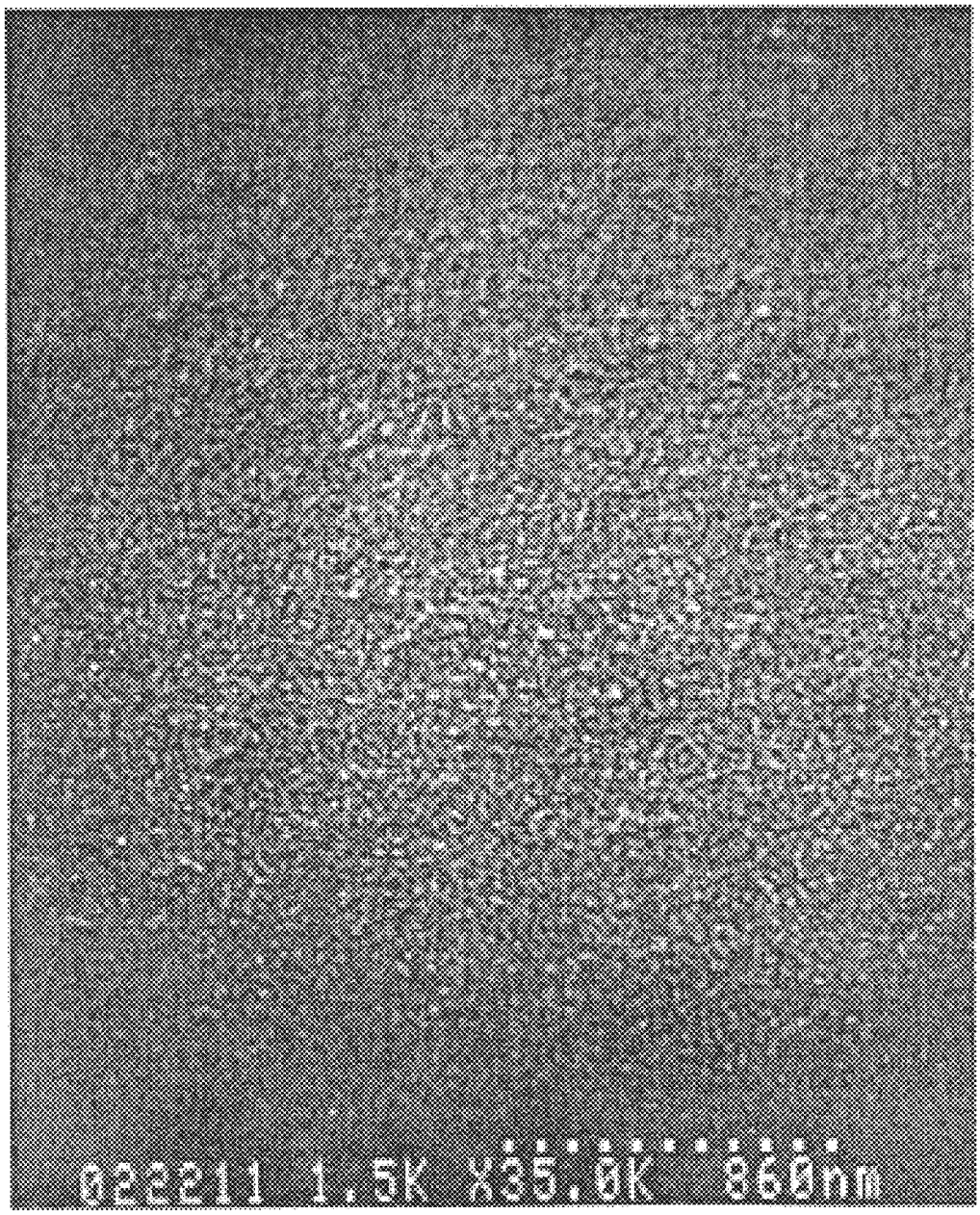
FIG. 3 is a photograph illustrating the heat-generating elements of the printer head shown in FIG. 1.
Figure 4:
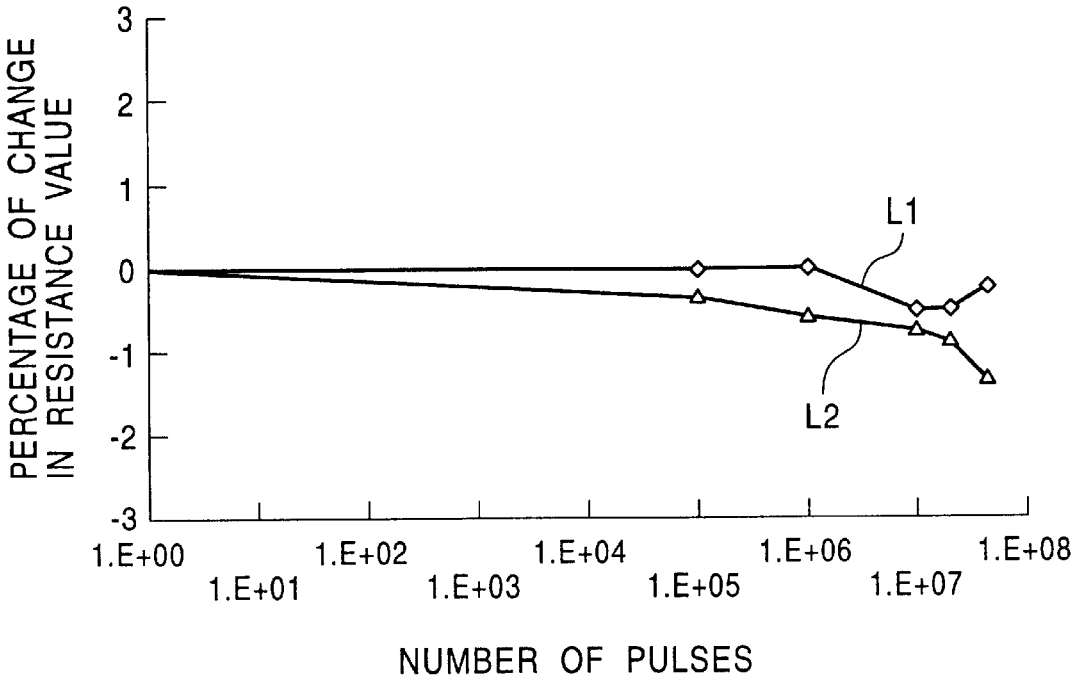
FIG. 4 is a properties curve illustrating the properties of the printer head shown in FIG. 1.

FIG. 3 is an SEM observation photograph showing the state of the surface of a heat-generating element 35, and by comparison with FIGS. 6 and 7 it can be understood that the resistor material is sufficiently adhered to the lower layer, since there are not protrusions or recesses formed whatsoever. Also, FIG. 4 shows experimental results of repeating passing pulses as a comparison with conventional heat-generating elements, and the improvement in reliability can be confirmed from these experimental results, as well. Also, this experiment involves applying electric power far greater than that actually applied in usage. The reference numeral L1 represents that of the printer head 21 according to the present embodiment, and reference numeral L2 represents that wherein the titanium nitride is positioned directly upon the lower layer, according to the conventional configuration. Incidentally, observing the surface state in the same manner with an SEM following such experimentation did not reveal any change in the printer head according to the present embodiment.

1-3 Advantages of the First Embodiment

According to the above configuration, the reliability of the heat-generating elements can be markedly improved over that of the conventional, by depositing a titanium layer which is a IV A metal layer following which a resistor material is deposited to form heat-generating elements.

Second Embodiment

Figure 5:
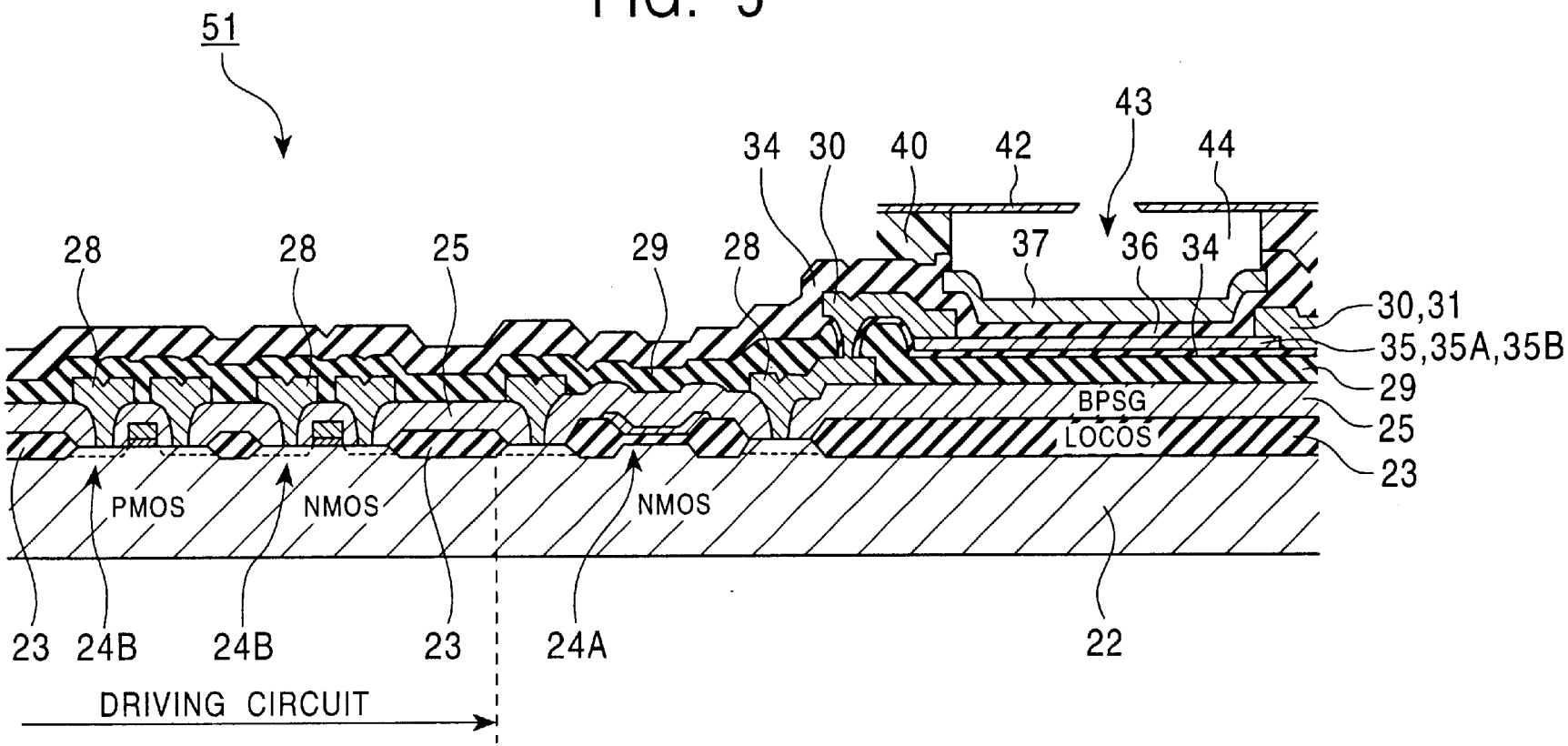
FIG. 5 is a cross-sectional diagram illustrating a printer head applied to the printer according to the second embodiment of the present invention.

FIG. 5 is a cross-sectional diagram illustrating a printer head applied to a printer according to a second embodiment of the present invention, as a comparison to FIG. 1. In the configuration shown in FIG. 5, configurations which are the same as the printer head described above with reference to FIG. 1 will be denoted with corresponding reference numerals, and redundant description will be omitted.

With this printer head 51, the driving circuit for driving the switching transistors 24A is formed by NMOS and PMOS transistors 24B being connected by the first layer of wiring pattern 28. Also, the driving circuit and the switching transistors 24A are connected by this first layer of wiring pattern 28. Subsequently, after the silicon nitride film 34 is deposited, the heat-generating elements 35 are formed, one end of the heat-generating elements 35 and the switching transistors 24A are connected by the second layer of wiring pattern 30, and also the other end of the heat-generating elements 35 is connected to the electric power line. Thus, the order of making the second layer of wiring pattern 30 and the heat-generating elements 35 is reversed with regard to that of the above-described first embodiment.

The heat-generating elements 35 are formed by depositing a tantalum resistor material 35B following depositing the titanium buffer layer 35A on the silicon nitride film 34 which is the lower layer. Thus, with the printer head 51 as well, the resistor material is deposited following depositing of the titanium layer which is a IV A metal layer to form the heat-generating elements, and tantalum is applied for this resistor material.

According to the above configuration, advantages the same as those of the first embodiment can be obtained by depositing a titanium layer which is a IV A metal layer following which a resistor material is deposited to form heat-generating elements, even in the event that tantalum is applied to the resistor material for forming the heat-generating elements.

Other Embodiments

Now, while the above embodiments have been described with regard to cases wherein the buffer layer is formed of titanium, of the IA A metal materials, the present invention is not restricted to this, and advantages the same as those of the above-described embodiments can be obtained by forming the buffer layer of other IV A metals such as zirconium or hafnium, and also advantages the same as those of the above-described embodiments can be obtained by forming the buffer layer of V A metal materials instead of IV A metal materials.

Also, while the above embodiments have been described with regard to cases wherein the buffer layer is formed of one layer of a IV A metal material, the present invention is not restricted to this, and since the essence of the present invention is to prevent change in the properties of the heat-generating elements by improving the binding with the lower layer, advantages the same of those of the above-described embodiments can be obtained by forming the buffer layer of a multi-layer structure wherein a IV A metal film or a V A metal film is positioned at the lower layer side.

Also, while the above embodiments have been described with regard to cases wherein titanium nitride or tantalum are used as the resistor material, the present invention is not restricted to this, and the same advantages can be obtained in cases of using other resistor materials as well.

Also, while the above embodiments have been described with regard to cases wherein silicon nitrides are deposited as the insulating layer of the lower layer for the heat-generating devices, the present invention is not restricted to this, and the same advantages can be obtained in cases of forming the insulating layer using various other insulating materials as well.

Also, while the above embodiments have been described with regard to cases of applying the present invention to printer heads of a configuration wherein ink is locally heated and printed, the present invention is not restricted to this, and can be widely applied to various types of printers heads which print by driving heat-generating elements, such as thermo-sensitive printer heads or the like, and further to printers using such printer heads.

As described above, according to the present invention, heat-generating elements are formed by depositing at least a IV A metal layer or a V A metal layer, followed by depositing a resistor material thereupon, so the reliability of the heat-generating elements can be improved over the conventional.

What is claimed is:

1. A printer head comprising:

a semiconductor substrate;

a doped oxide film disposed on said semiconductor substrate;

a dielectric layer disposed on said doped oxide film;

a heat-generating element disposed on said dielectric layer;

a transistor which drives said heat-generating element to generate heat for printing a desired image; and an anti-cavitation layer disposed on said heat-generating element;

wherein said heat-generating element is formed by depositing at least one of a IV A metal layer and a V A metal layer on said dielectric layer.

2. The printer head according to claim 1, further comprising an ink protecting layer disposed on said heat-generating element.

3. A method for manufacturing a printer head comprising:

disposing a doped oxide film on a semiconductor substrate;

disposing a dielectric layer on said doped oxide film;

disposing at least one of a IV A metal layer and a V A metal layer on said dielectric layer to form a heat-generating element;

disposing a resistor material upon said heat-generating element; and driving said heat-generating element using a transistor, to generate heat and to print a desired image.

4. A printer head comprising:

a semiconductor substrate;

a doped oxide film disposed on said semiconductor substrate;

an oxidized silicon film disposed on said doped oxide film;

an insulating layer disposed on said oxidized silicon film;

a heat-generating element disposed on said insulating layer;

a transistor which drives said heat-generating element to generate heat for printing a desired image; and an anti-cavitation layer disposed on said heat-generating element;

wherein said heat-generating element is formed by depositing at least one of a IV A metal layer and a V A metal layer on said insulating layer.

5. The printer head according to claim 4, wherein said insulating layer is a silicon nitride layer.

6. A method for manufacturing a printer head comprising:

disposing a doped oxide film on a semiconductor substrate;

disposing an oxidized silicon film on said doped oxide film;

disposing an insulating layer on said oxidized silicon film;

disposing at least one of a IV A metal layer and a V A metal layer on said insulating layer to form a heat-generating element;

disposing a resistor material upon said heat-generating element; and driving said heat-generating element using a transistor, to generate heat and to print a desired image.

7. The method according to claim 6, wherein said insulating layer is a silicon nitride layer.

* * * * *